US007676934B2

(12) United States Patent
Liao

(10) Patent No.: US 7,676,934 B2
(45) Date of Patent: Mar. 16, 2010

(54) KEYLESS ADJUSTING MECHANISM FOR CHAIN SAW

(75) Inventor: Chia-Hsing Liao, Tao Yuan Hsien (TW)

(73) Assignee: Hsin-Chih Chung Lee, Tao Yuan Hsien (TW)

( * ) Notice: Subject to any disclaimer, the term of this patent is extended or adjusted under 35 U.S.C. 154(b) by 531 days.

(21) Appl. No.: 11/612,833

(22) Filed: Dec. 19, 2006

(65) Prior Publication Data

US 2008/0141544 A1 Jun. 19, 2008

(51) Int. Cl.
*B27B 17/14* (2006.01)

(52) U.S. Cl. ..... 30/386; 30/383

(58) Field of Classification Search ..... 30/385, 30/386, 383; 83/816
See application file for complete search history.

(56) References Cited

U.S. PATENT DOCUMENTS

| | | | | |
|---|---|---|---|---|
| 3,866,320 | A * | 2/1975 | Progl | 30/386 |
| 4,835,868 | A * | 6/1989 | Nagashima | 30/386 |
| 5,896,670 | A * | 4/1999 | Gibson et al. | 30/386 |
| 6,532,671 | B1 * | 3/2003 | Jong | 30/386 |
| 6,782,627 | B2 * | 8/2004 | Hermes et al. | 30/386 |
| 7,155,832 | B2 * | 1/2007 | Warfel et al. | 30/386 |
| 7,322,114 | B2 * | 1/2008 | Kawamura | 30/386 |
| 7,350,301 | B2 * | 4/2008 | Chung Lee | 30/386 |
| 7,434,502 | B2 * | 10/2008 | Keeton et al. | 83/816 |
| 2007/0062361 | A1 * | 3/2007 | Xiong et al. | 83/814 |
| 2009/0241353 | A1 * | 10/2009 | Ericson et al. | 30/386 |

FOREIGN PATENT DOCUMENTS

| | | |
|---|---|---|
| TW | 503810 | 9/2002 |
| TW | M284520 | 1/2006 |

* cited by examiner

*Primary Examiner*—Hwei-Siu C Payer
(74) *Attorney, Agent, or Firm*—Rabin & Berdo, P.C.

(57) ABSTRACT

A keyless adjusting mechanism for a chain saw is disclosed herein, which comprises a protection cover, an adjusting bolt, an adjusting stud, and an adjusting ring with a driver gear, wherein the adjusting bolt is coupled with a driven gear for engaging with the driver gear of the adjusting ring, the adjusting stud is coupled with a chain board and has a threaded hole for engaging with the corresponding adjusting bolt. Accordingly, when the adjusting ring is rotated, the driver gear can bring the driven gear to let the adjusting stud move axially along the adjusting bolt such that the chain could be adjusted to tighten or loosen. In addition, a knob with a handle is coupled to the adjusting ring. The handle can be withdrawn in the knob or extended out of the knob for convenient twist.

6 Claims, 8 Drawing Sheets

KEYLESS ADJUSTING MECHANISM FOR CHAIN SAW

BACKGROUND OF THE INVENTION

1. Field of the Invention

The present invention generally relates to an adjusting mechanism for a chain saw that can adjust a tension of a chain without using auxiliary tools.

2. The Prior Arts

Taiwan application Nos. 90,213,097 and 94,211,435 both disclose an adjusting mechanism for adjusting a tension of a chain without using auxiliary tools. The conventional adjusting mechanism has a complicated structure, and has a knob that is inconvenient to twist.

SUMMARY OF THE INVENTION

An objective of the present invention is to provide an adjusting mechanism for a chain saw, which has simple structure and is laborsaving for adjusting a tension of a chain.

Based on the above-mentioned objective, an adjust mechanism for a chain saw comprises a protection cover, an adjusting ring having a driver gear, an adjusting bolt having a driven gear for engaging with driver gear, and an adjusting stud. The adjusting stud is coupled with a chain board and has a threaded hole for engaging with the corresponding adjusting bolt. Hence, when the adjusting ring is rotated, the driver gear brings the driven gear to let the adjusting stud move axially along the adjusting bolt, whereby a chain can be adjusted to tighten or loosen. In addition, a knob with a handle is coupled to the adjusting ring. The handle could be withdrawn in the knob or extended out of the knob for convenient twist.

The adjusting ring has a knob recess for receiving the knob. The knob has a through hole formed on a first end surface thereof corresponding to the knob recess of the adjusting ring, a positioning block disposed in the through hole, and a spring mounted between the positioning block and the knob recess of the adjusting ring for pushing the positioning block to project through the through hole. The knob further has a handle slot for receiving the handle. An end surface of the handle corresponding to the handle slot has a concave recess formed on respective sides thereof, in which the concave recess is biased against the positioning block. Moreover, a bottom surface of the handle slot is an inclined surface, whereby the handle can prevent from being obstructed by the protection cover when it is extended for operation.

The driver gear and the driven gear of the adjusting mechanism in accordance with the present invention are preferably bevel gears, which allows the gears with non-parallel and non-vertical shafts to transmit power.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1A:
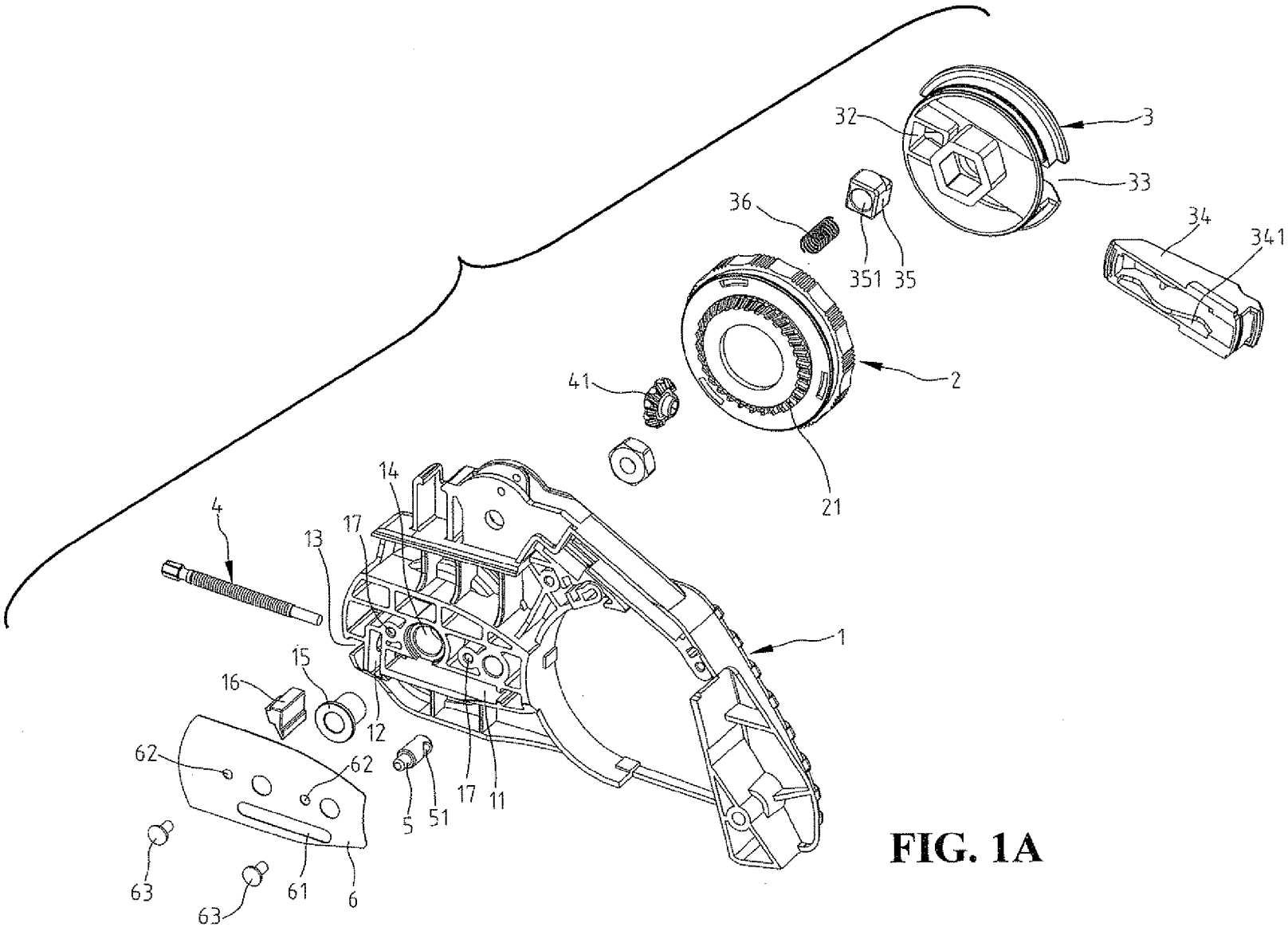
FIG. 1A is an exploded view showing a keyless adjusting mechanism for a chain saw in first direction in accordance with the present invention.
Figure 1B:
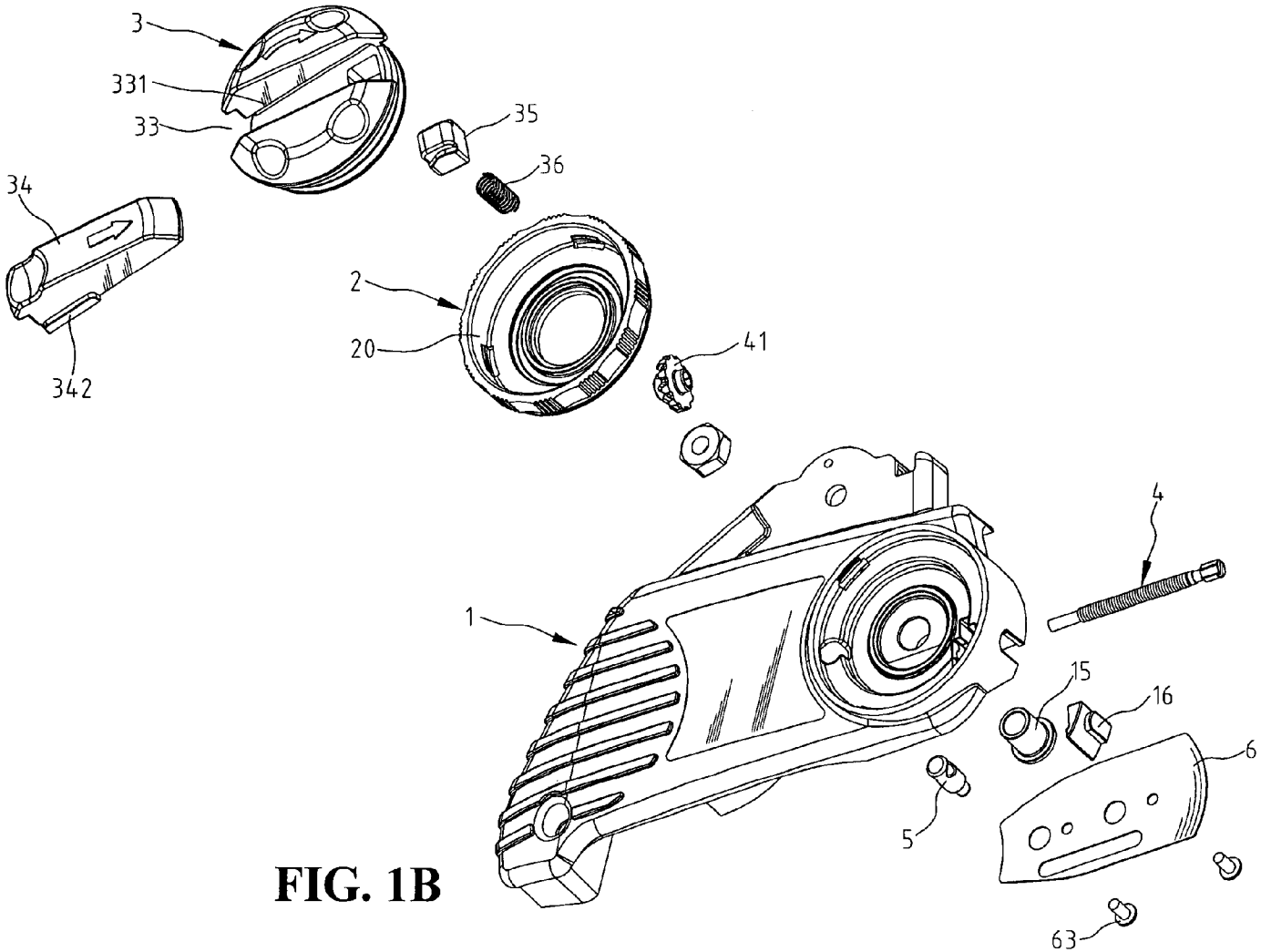
FIG. 1B is an exploded view showing a keyless adjusting mechanism for a chain saw in second direction in accordance with the present invention.
Figure 2A:
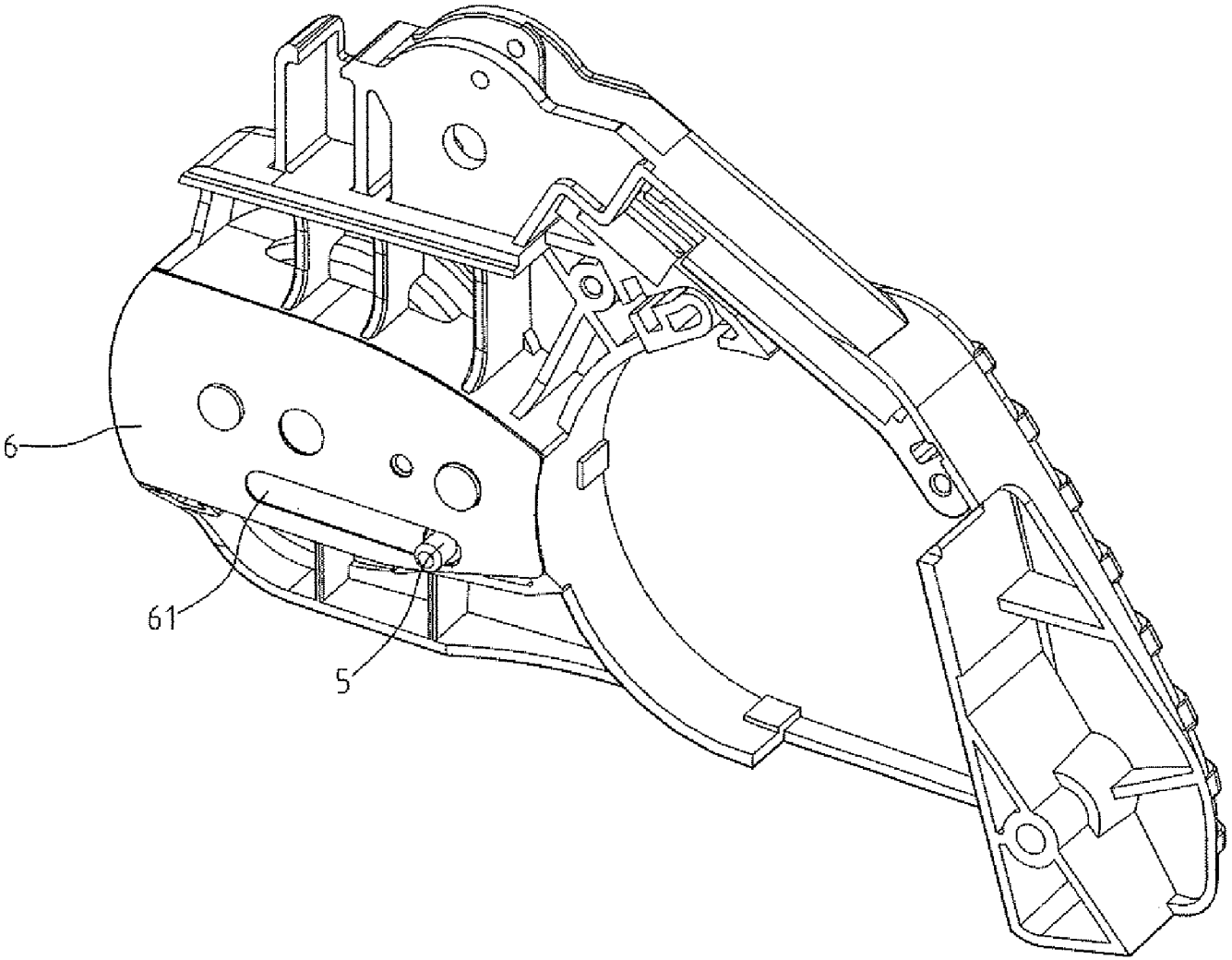
FIG. 2A is a perspective view showing an assembled keyless adjusting mechanism in first direction in accordance with present invention.
Figure 3:
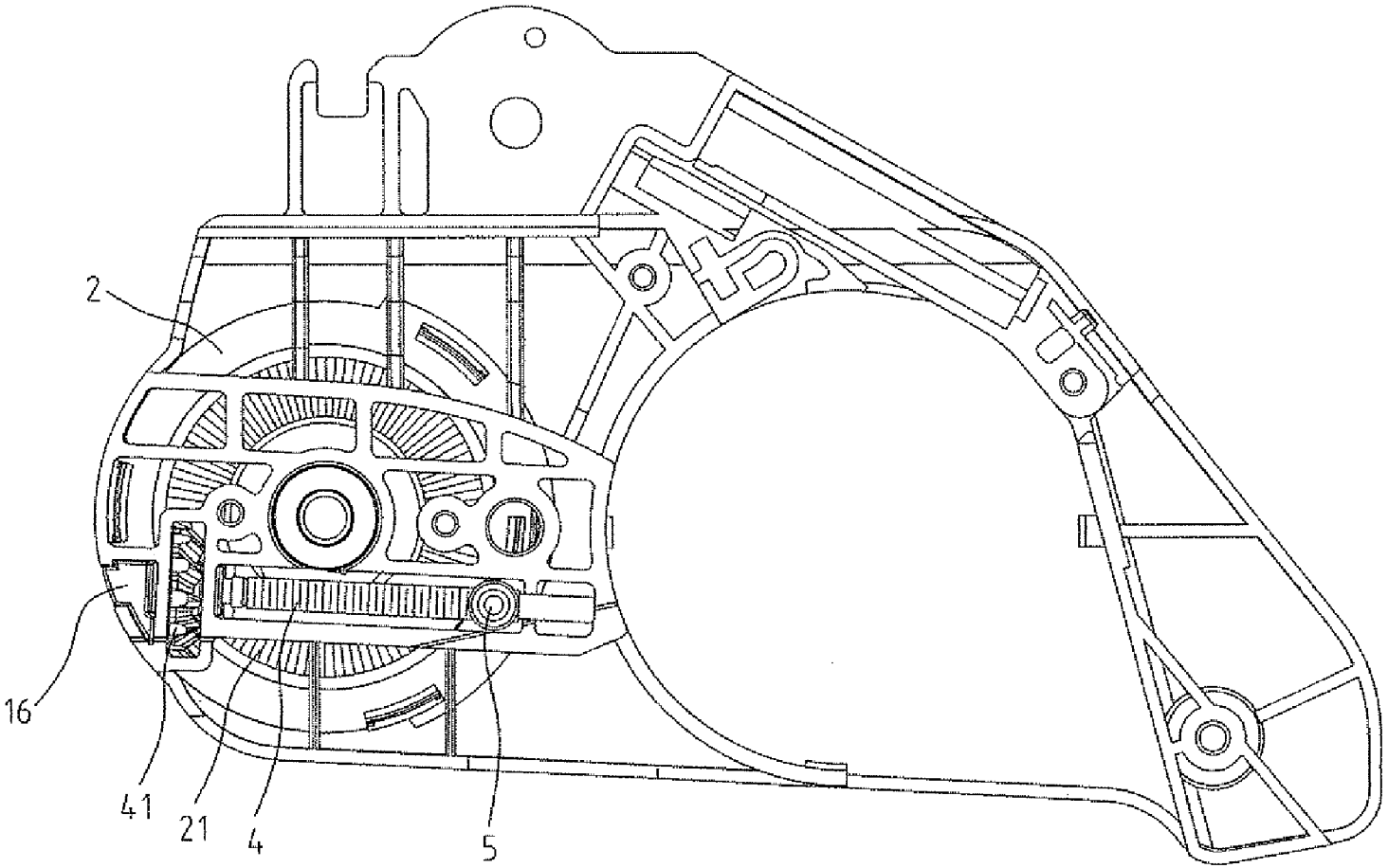
FIG. 3 is a cross-sectional view showing an assembled keyless adjusting mechanism in accordance with present invention.

Referring to FIG. 1A and FIG. 1B, a keyless adjusting mechanism for a chain saw in accordance with a preferred embodiment of the present invention comprises a protection cover 1 having a first side and an opposite second side. A central hole 14 is formed from the first side to the second side of the protection cover 1 and has a bushing 15 received therein. The first side of the protection cover 1 has a first cover recess 11, a second cover recess 12, and a third cover recess 13 arranged in a line. The first cover recess 11 has a relatively longer length for receiving an adjusting bolt 4, which extends to the second recess 12. A driven gear 41 is coupled to an end of the adjusting bolt 4 and is received in the second cover recess 12. An elastic stopper 16 is received in the third cover recess 13 and is contacted with an end portion of the adjusting bolt 4 to prevent the adjusting bolt 4 from moving axially (see FIG. 3). In addition, an adjusting stud 5 used to connect a chain board (not shown) has a threaded hole 51 for engaging with the adjusting bolt 4. After the adjusting bolt 4, the driven gear 41 and the elastic stopper 16 are respectively installed in the first cover recess 11, the second cover recess 12 and the third cover recess 13, a gasket 6 is attached onto the protection cover 1 by inserting a screw 63 through a penetrating hole 62 on the gasket 6 and screwing into a screw hole 17 of the protection cover 1. Meanwhile the adjusting stud 5 projects through a gasket slot 61 of the gasket 6 (see FIG. 2A).

Figure 4:
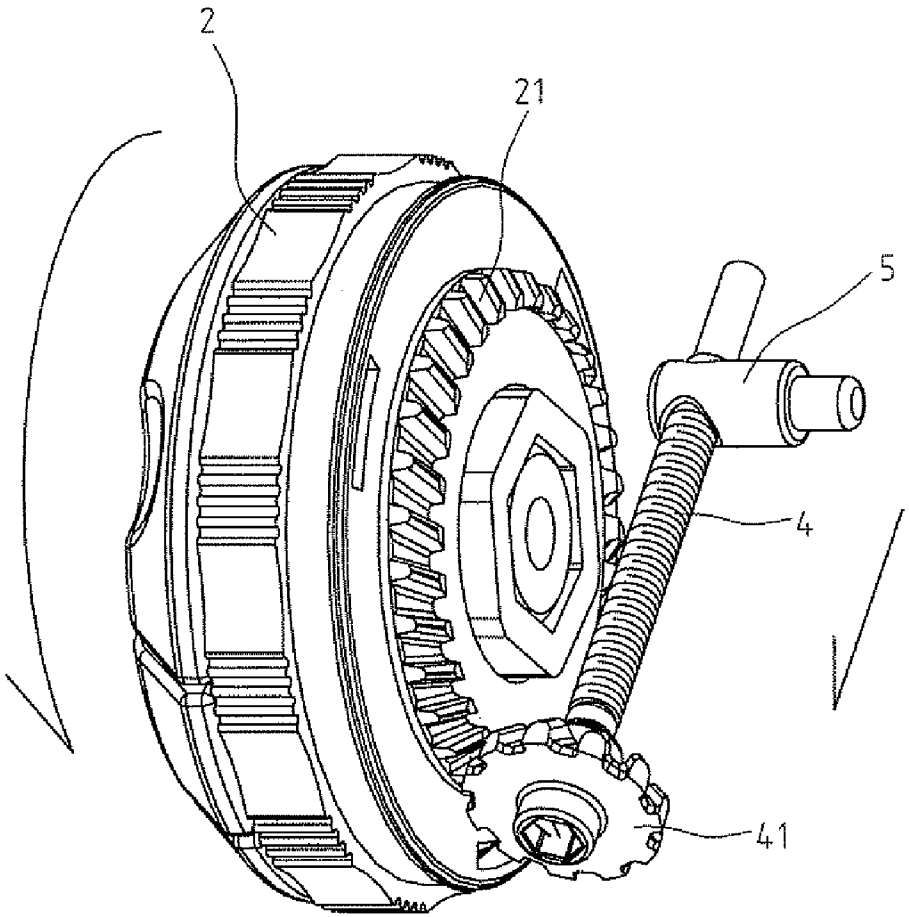
FIG. 4 is a perspective partial view showing that a knob drives an adjusting stud to move axially along an adjusting bolt.

The second side of the protection cover 1 is coupled with an adjusting ring 2 which can be further coupled with a knob 3. The adjusting ring 2 has a driver gear 21 axially extended from a first end surface thereof. A central shaft (not shown) connects the adjusting ring 2 to the bushing 15 disposed in the central hole 14 of the protection cover 1, and meanwhile, the driver gear 21 is engaged with the driven gear 41. When the adjusting ring 2 is rotated, the driving gear 21 brings the driven gear 41 to let the adjusting bolt 4 rotate at the same time, so that the adjusting stud 5 can move axially along adjusting bolt 4 (see FIG. 4), and the chain board mounted on the adjusting stud 5 can be adjusted to tighten or loosen the chain. The moving direction of the adjusting stud 5 along the adjusting bolt 4 is depended on the rotation direction of the adjusting ring 2.

Figure 2B:
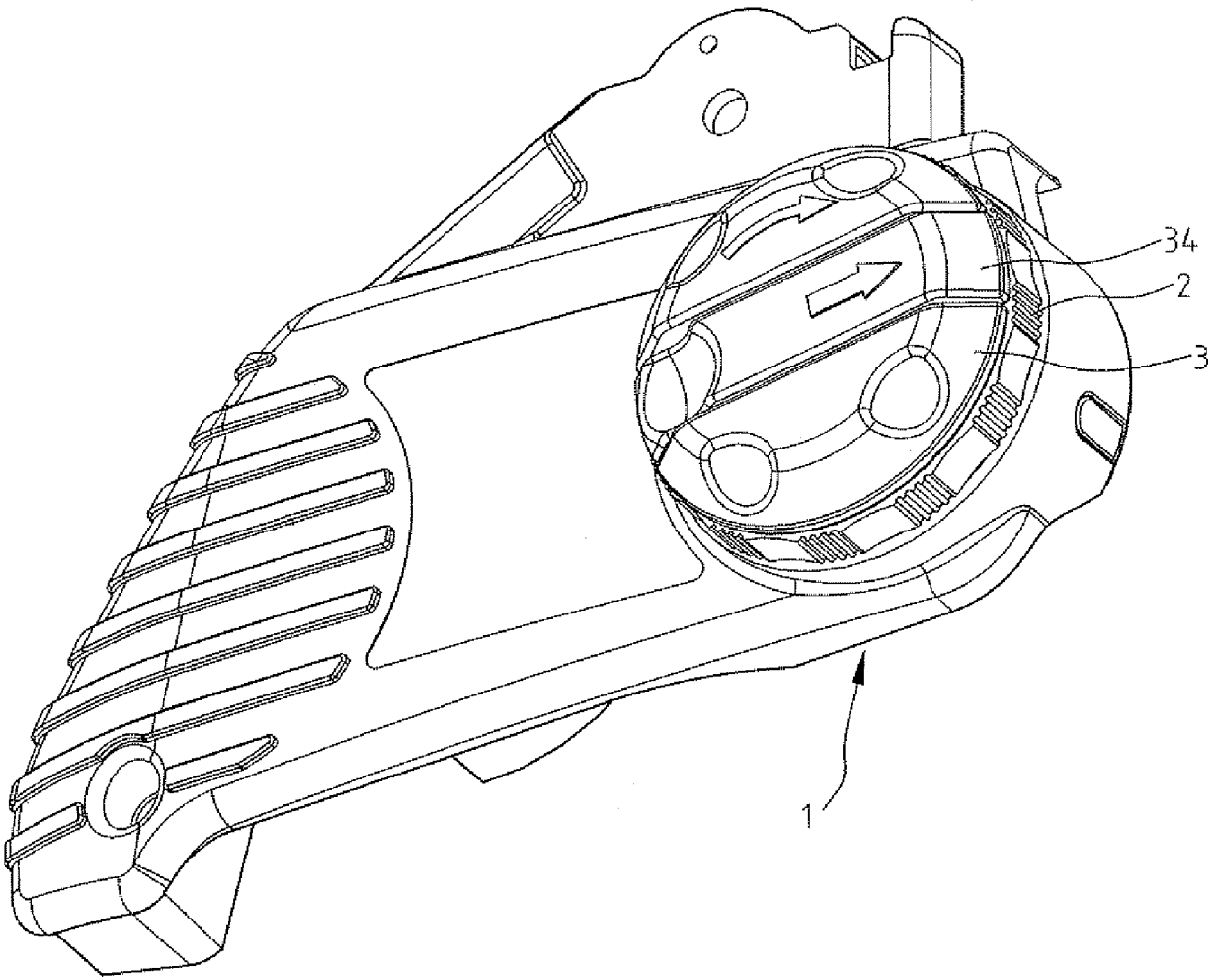
FIG. 2B is a perspective view showing an assembled keyless adjusting mechanism in second direction in accordance with present invention.
Figure 2C:
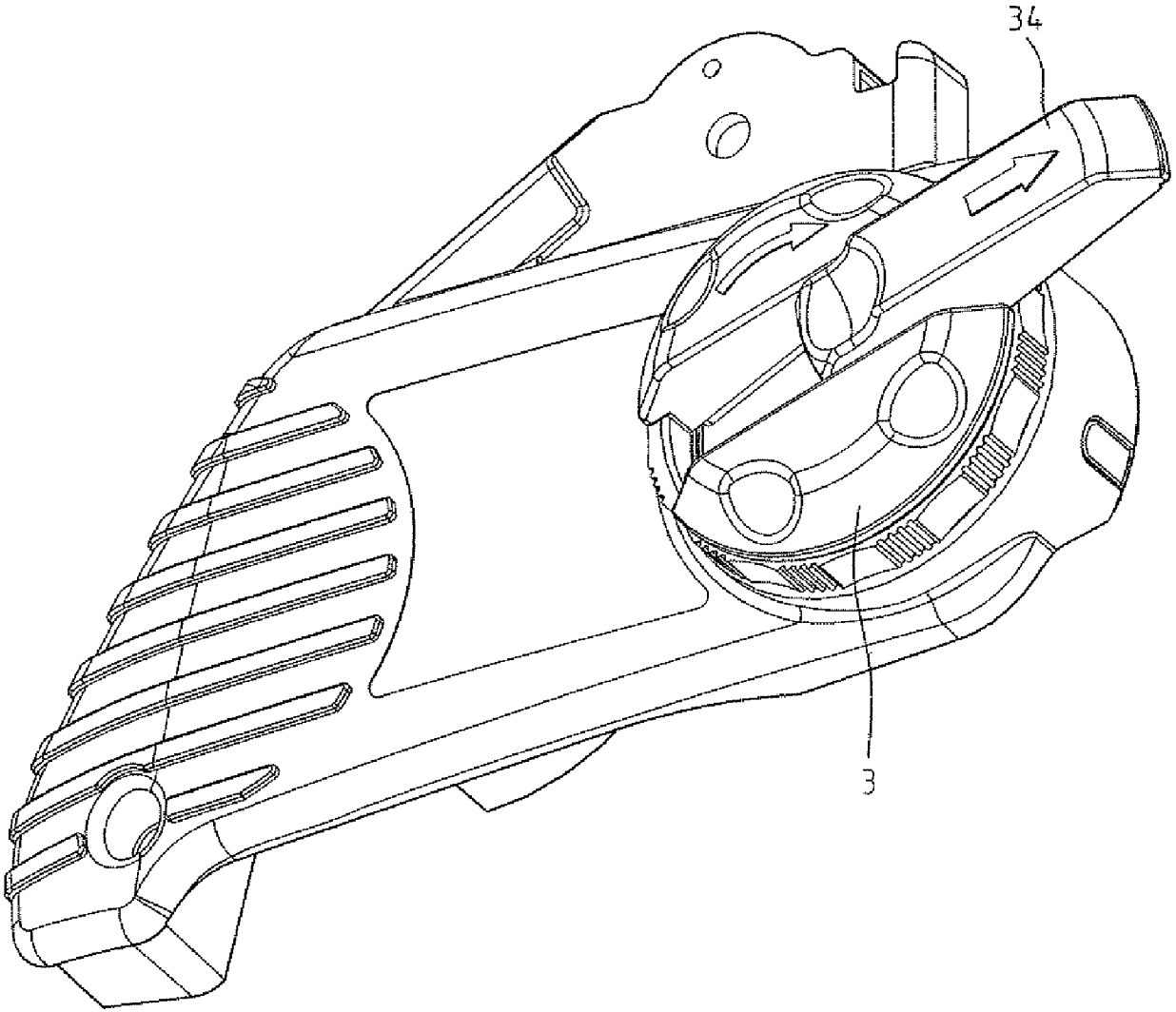
FIG. 2C is a perspective view showing that a handle is slid forward to extend out of a knob.
Figure 5:
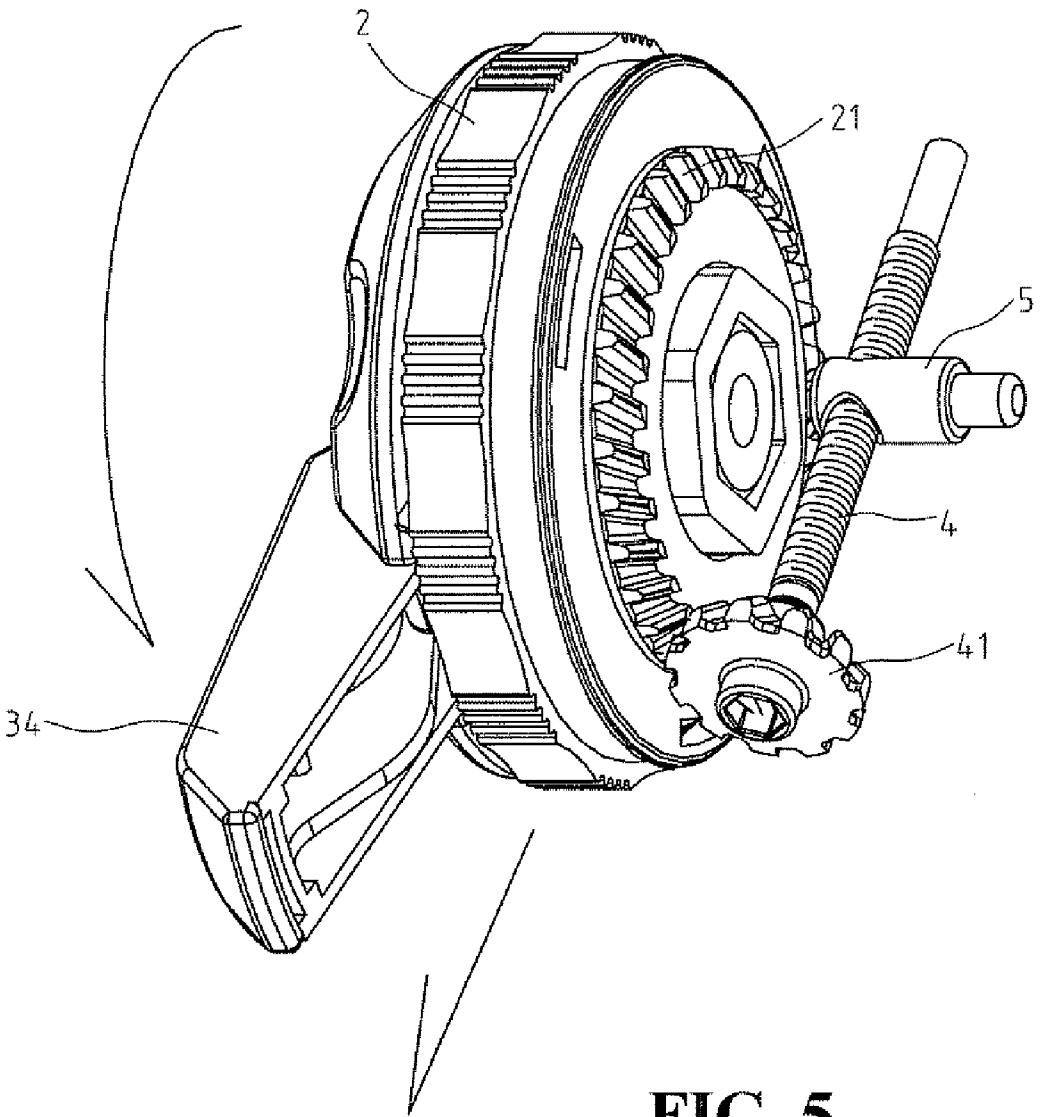
FIG. 5 is a perspective view showing that a handle extends out of a knob.

In addition, a second end surface of the adjusting ring 2 is further coupled with a knob 3 with a movable handle 34 which can slide relative to the knob 3 and extend out from a rim of the knob 3 for conveniently twisting the knob 3 (see FIG. 2C and FIG. 5). The second end surface of the adjusting ring 2 is preferably provided with a knob recess 20 for receiving the knob 3. The knob 3 has a through hole 32 formed on a first end surface corresponding to the knob recess 20, a positioning block 35 with a cave hole 351 disposed in the through hole 32, and a spring 36 having an end sleeved in the cave hole 351 and another end pressed against the knob recess 20, such that the spring 36 can push the positioning block 35 to project through the through hole 32. A second end surface of the knob 3 is provided with a handle slot 33 for receiving the handle 34. A bottom surface of the handle slot 33 is an inclined surface, and has guide slot 331 formed on two sides thereof. An end surface of the handle 34 corresponding to the knob 3 has two concave recess 341 formed on respective sides thereof, such that the concave recess 341 can be biased against the positioning block 35. The protrusion bars 342 are provided at two sides of the handle 34 for slidably engaging with the guide slot 331 of the handle slot 33, whereby the handle 34 can slide in the handle slot 33 of the knob 3 (see FIG. 2B). For conveniently twisting the knob 3, the handle 34 can be slid forward along the handle slot 33 to extend out form the rim of the knob 3 (see FIG. 2C), and concave recess 341 of the handle 34 is biased against the positioning block 35 to position the handle 34. Moreover, by means of the inclined surface of the handle slot 33, the handle 34 can prevent from being obstructed by the protection cover 1 when it is extended out from the rim of the knob 3 for operation.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A keyless adjusting mechanism for a chain saw, comprising:

a protection cover having a central hole;

an adjusting ring having a driver gear axially extended from a first end surface thereof, the adjusting ring being connected to the central hole of the protection cover;

an adjusting bolt disposed at the protection cover and having a driven gear secured thereon for engaging with the driver gear;

an adjusting stud having a threaded hole for engaging with the adjusting bolt;

wherein the driver gear, the driven gear and the adjusting bolt bring the adjusting stud to move axially along the adjusting bolt when the adjusting ring is rotated; and a knob coupled to the adjusting ring, the knob having a handle that is slidable to extend out from a rim of the knob, so as to provide a larger torque for twisting the adjusting ring than only using the knob; and wherein the adjusting ring has a second end surface opposite the first end surface, and the second end surface has a knob recess for receiving the knob, and the knob recess is concentric with the adjusting ring.

2. The keyless adjusting mechanism for a chain saw as claimed in claim 1, wherein the driver gear and the driven gear are bevel gears.

3. A keyless adjusting mechanism for a chain saw comprising:

a protection cover having a central hole;

an adjusting ring having a driver gear axially extended from a first end surface thereof, the adjusting ring being connected to the central hole of the protection cover;

an adjusting bolt disposed at the protection cover and having a driven gear secured thereon for engaging with the driver gear; and an adjusting stud having a threaded hole for engaging with the adjusting bolt; wherein the driver gear, the driven gear and the adjusting bolt bring the adjusting stud to move axially along the adjusting bolt when the adjusting ring is rotated;

a knob with a handle is coupled to the adjusting ring, in which the handle can rotate with the knob and extend out from a rim of the knob; and the adjusting ring has a second end surface opposite to the first end surface, and the second end surface has a knob recess for receiving the knob, the knob has a through hole formed on a first end surface thereof corresponding to the knob recess, a positioning block disposed in the through hole, and a spring mounted between the positioning block and the knob recess of the adjusting ring for pushing the positioning block to project through the through hole, and an end surface of the handle corresponding to the knob has a concave recess formed on respective sides thereof to bias against the positioning block.

4. The keyless adjusting mechanism for a chain saw as claimed in claim 3, wherein the knob has a second end surface opposite to the first end surface of the knob, and the second end surface of the knob the second end surface of the knob has a handle slot for receiving the handle, a bottom surface of the handle slot has guide slots formed on two sides thereof, and the handle has protrusion bars formed on two sides thereof for slidably engaging with the guide slots.

5. The keyless adjusting mechanism for a chain saw as claimed in claim 4, wherein the bottom surface of the handle slot is an inclined surface.

6. A keyless adjusting mechanism for a chain saw comprising:

a protection cover having a central hole;

an adjusting ring having a driver gear axially extended from a first end surface thereof, the adjusting ring being connected to the central hole of the protection cover;

an adjusting bolt disposed at the protection cover and having a driven gear secured thereon for engaging with the driver gear; and an adjusting stud having a threaded hole for engaging with the adjusting bolt; wherein the driver gear, the driven gear and the adjusting bolt bring the adjusting stud to move axially along the adjusting bolt when the adjusting ring is rotated; and the protection cover has a first cover recess for receiving the adjusting bolt, a second cover recess for receiving the driven gear, and a third cover recess for receiving an elastic stopper, which is contacted with an end of the adjusting bolt.

* * * * *